United States Patent [19]

Hastings, deceased et al.

[11] 4,438,669

[45] * Mar. 27, 1984

[54] ADJUSTABLE RATCHET PLIERS

[76] Inventors: Charles E. Hastings, deceased, late of Orlando, Fla.; by June Hastings, heir, 3404 Paris Pl., Orlando, Fla. 32808

[ * ] Notice: The portion of the term of this patent subsequent to May 26, 1981 has been disclaimed.

[21] Appl. No.: 263,749

[22] Filed: May 14, 1981

Related U.S. Application Data

[63] Continuation-in-part of Ser. No. 101,552, Dec. 10, 1979, Pat. No. 4,269,089, and Ser. No. 963,433, Nov. 24, 1978, abandoned.

[51] Int. Cl.[3] ..... B25B 7/04

[52] U.S. Cl. ..... 81/410 R

[58] Field of Search ..... 81/355, 357, 385, 393, 81/405, 407–414

[56] References Cited

U.S. PATENT DOCUMENTS

| | | | |
|---|---|---|---|
| 1,565,210 | 12/1925 | Seiber | 81/410 R |
| 2,361,607 | 10/1944 | Daniels | 81/410 R |
| 2,704,471 | 3/1955 | Hendrickson | 81/410 R |
| 4,269,089 | 5/1981 | Hastings | 81/410 R |

FOREIGN PATENT DOCUMENTS

| | | | |
|---|---|---|---|
| 958459 | 2/1957 | Fed. Rep. of Germany | 81/411 |
| 1185936 | 2/1959 | France | 81/410 R |

*Primary Examiner*—James L. Jones, Jr.

*Attorney, Agent, or Firm*—Price, Heneveld, Huizenga & Cooper

[57] ABSTRACT

Adjustable ratchet pliers having jaw members that can be easily and rapidly adjusted to accommodate different size workpieces and in which one jaw member includes a slide track with a sunken area located along an elongated slot and the other jaw member includes a slide member that carries a locking means. The slide member has a portion which slides within the sunken area to keep the locking means in the proper position to provide a smooth action of the plies during adjustment.

4 Claims, 7 Drawing Figures

ADJUSTABLE RATCHET PLIERS

This is a continuation-in-part of applications Ser. No. 963,433, filed Nov. 24, 1978, now abandoned, and Ser. No. 101,552, filed Dec. 10, 1979, now U.S. Pat. No. 4,269,089.

BACKGROUND OF THE INVENTION

This invention relates to pliers tools and more specifically to a ratchet pliers having jaw members that may be easily and rapidly adjusted to accommodate different size workpieces.

Attempts have been made in the past to provide for rapid adjustment of pliers jaw members. One such example is U.S. Pat. No. 3,534,641 granted to Donald Le Duc on Oct. 20, 1970. This patent teaches an adjustable pliers tool having a pair of pivotal crossed handle members and a slidable jaw member. One handle includes a fixed jaw which cooperates with the slidable jaw member. A toothed pawl is disposed about the pivot and projects into a slot in one handle member for engaging a plurality of slot teeth disposed therein. The pawl is biased into engagement with the slot teeth by a spring supported on the pivot. In operation, the pliers are adjusted over a workpiece and pressure applied on the handles to cause a camming surface on one handle to cam against the edge of the slidable jaw and force it up against the workpiece.

Prior U.S. Pat. Nos. 2,704,471; 2,361,607; and 1,565,210 and German Pat. No. 958,459 each show adjustable pliers having locking members working in conjunction with tracks.

In all these prior patents, the pawl of the locking means has no adequate means for guiding the sliding movement of one jaw member relative to the other. Further, adjustment of the jaws to open position can only be accomplished by pivoting the handles to open position relative to one another.

The applicant's device includes two embodiments. In both embodiments, a separate guide means is provided to guide the slidable closing of the jaws. Therefore, the pawl has the sole function of locking one jaw with respect to the other while at the same time permitting the pliers to be rapidly slid into closed position upon a workpiece while the handles are in the closed mode. In one embodiment, a means is provided to open the jaws without pivoting the handles to open mode.

SUMMARY OF THE INVENTION

This invention provides an adjustable ratchet pliers having a pair of jaw members that may be easily and smoothly adjusted to a selected open or closed mode or rapidly adjusted to a closed mode. The jaw members are intergal with a pair of pivotally coupled handle members.

The first jaw member includes a slot defining a surface having tooth cavities and an opposed surface. Surrounding the slot is a recess or sunken area. Freely rotatable on the pivot and within the slot is a ratchet dog or pawl that includes a tooth, biasing means, and a release shelf. The ratchet dog tooth is normally biased into engagement with the toothed cavities of the slot. In one embodiment, an abutment projects from the surface of the second jaw member into the slot and in the path of the ratchet dog shelf but normally free of contact therewith. To rapidly engage a workpiece, the handles need only be maintained in a closed relationship to one another. The second handle is shifted upward and parallel to the slot in the first handle wherein the second jaw member closes toward the first jaw member. To allow this to occur, the ratchet dog, which until this time is biased into full engagement with the teeth cavities of the slot, is urged to pivot out of engagement and thereafter to ratchet along the crest of the teeth. When the jaw members close in and contact the workpiece, the second handle can no longer be shifted and the ratchet dog engages the nearest tooth in the slot. The sliding of the jaw members relative to each other and the ratchet dog within the slot is guided by a guide member riding in the recess or sunken area adjacent the slot.

In closed position, the pliers handles are compressed and the jaw members tightly grip the workpiece. In one embodiment, the jaw members are easily released from the workpiece by pivoting the handle members outward from one another. As the jaw members pivot, the abutment on the second jaw member is rapidly displaced to contact the ratchet dog shelf and urge the ratchet dog out of engagement with the slot cavity. At this time, the jaw members may be easily adjusted. When the handle members are pivoted toward one another, the abutment is radially displaced free of the ratchet dog whereby the ratchet dog is free to reengage the slot cavity.

In the second embodiment, a pin is secured to the ratchet dog and a slot is provided in one of the jaw members through which the pin extends. The operator can actuate the pin to rotate the ratchet dog out of locked position thus eliminating the need for pivoting the handles for unlocking.

Another object of this invention is to provide an adjustable pliers whereby the jaw members can be smoothly and rapidly closed upon a workpiece without displacing the pliers handles relative to one another.

A further object of this invention is to provide an adjustable pliers that can be adjusted without jamming.

A still further object of this invention is to provide an adjustable pliers whereby the jaw members do not have to be parallel to each other in order to grip the workpiece.

Other objects, features and advantages of the present invention will become more apparent from the following description, including appended claims, and accompanying drawings, in which:

BRIEF DESCRITPION OF THE DRAWINGS

DESCRIPTION OF THE PREFERRED EMBODIMENT

Figure 1:
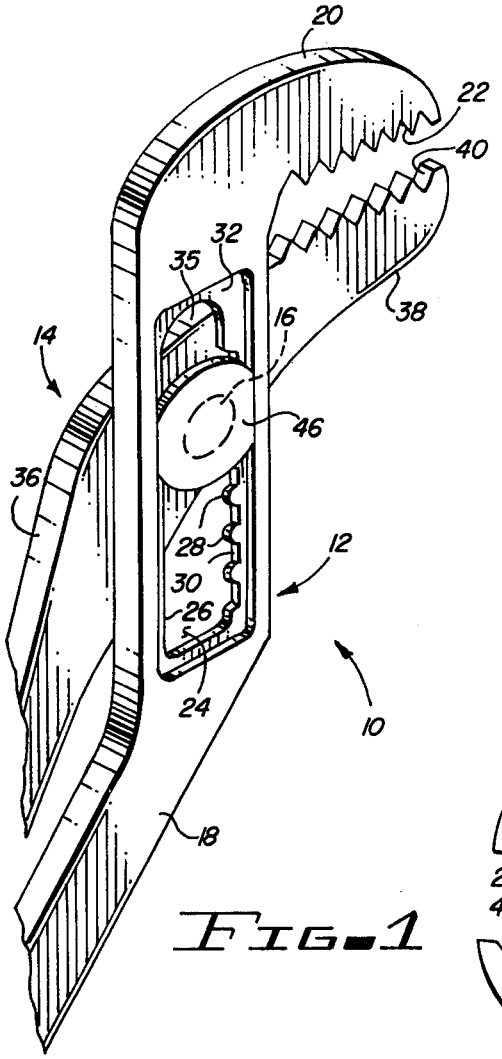
FIG. 1 is a perspective view of the improved pliers tool in accordance with the invention.
Figure 2:
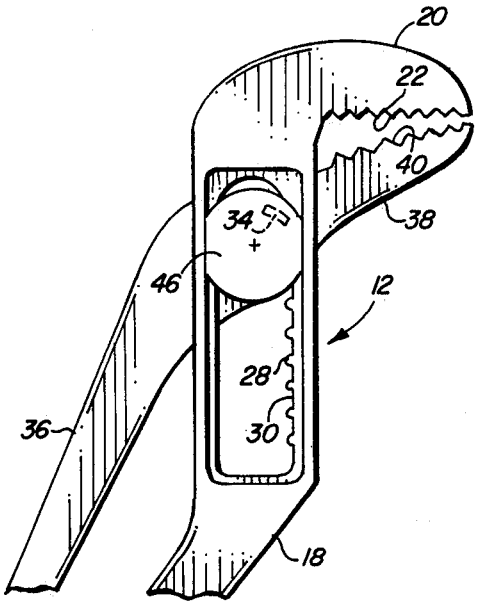
FIG. 2 is an elevational view of the improved pliers tool of FIG. 1.

Referring to the drawings, and to FIGS. 1 and 2 in particular, there is generally designated by the reference character 10 a pliers embodiment construction in accordance with the invention. The pliers 10 includes a first jaw member 12 and a second jaw member 14 that are pivotally connected by a pivot pin 16.

Jaw member 12 includes an elongated handle portion 18 and a jaw head portion 20. Jaw head portion 20 has an engaging surface 22 disposed thereon and includes an elongated slot 24.

A surface 26 of slot 24 is smooth while the opposite surface 28 thereof is formed with a plurality of cavities 30. A shallow recess 32 circumvents the periphery of slot 24.

Jaw member 14 includes a fixed abutment 34, a handle portion 36 and a jaw head portion 38. Jaw head portion 38 has an engaging surface 40 disposed thereon that is in alignment with and opposed to engaging surface 22 of jaw head portion 20. As illustrated, engaging surfaces 22 and 40 are serrated, but it will, of course, be understood that they may be smooth surfaces, if desired. In either event, surfaces 22 and 40 are generally disposed in a substantially parallel spaced relationship.

Abutment 34 is radially disposed from pivot pin 16 and projects from a surface of jaw member 14 into slot 24. Abutment 34 is further disposed normally free of a cooperating ratchet dog 42.

Pin 16 includes a shaft portion 44 that has an enlarged head portion 46 at one end and a threaded portion 48 at the opposite end thereof.

Head portion 46 is defined by a thin silhouette and a diameter that is slidable within recess 32. The length of shaft portion 44 is greater than the combined thicknesses of first jaw member 12 and second jaw member 14 to allow for unrestricted pivotal movement therebetween.

The jaw members are confined in a pivotal relationship by a lock nut 50 on the threaded portion 48. A spring washer 52 imparts a controlled friction between the jaw members during operation.

As illustrated in FIGS. 3–6, ratchet dog 42 is pivotally supported about pin 16 and includes a tooth 54 that functionally engages a selected cavity 30 of slot surface 28.

Disposed in a step portion 58 of ratchet dog 42 is a recptacle 59. Confined in receptacle 59 is a spring 60 and a ratchet pin 62. Spring 60 is always partially compressed by one end of ratchet pin 62 while the opposite end thereof is in continual sliding contact with slot surface 26. The combined effect to spring 60, ratchet pin 62 and surface 28 is to bias ratchet dog tooth 54 into engagement with surface 26. Proximate tooth 54 and in the rotational path of abutment 34 is a release shelf 64.

Figure 6:
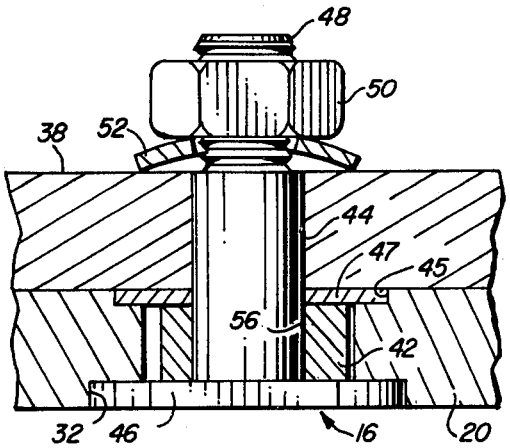
FIG. 6 is a sectional view showing the ratchet dog, ratchet pin and related components.

The position of pin 16, which is attached to ratchet dog 42 through opening 56, relative to tooth 54 is such that a force at pin 16 directed parallel to slot 24 and away from the jaw members will induce tooth 54 to increasingly engage tooth cavity 30. Conversely, a force directed parallel to slot 24 and toward the jaw members will induce tooth 54 to disengage from tooth cavity 30. In FIG. 6, a raised annular ledge 47 on jaw portion 38 fits into a sunken annular portion 45 in jaw head portion 20 to provide greater support between the jaws.

Figure 3:
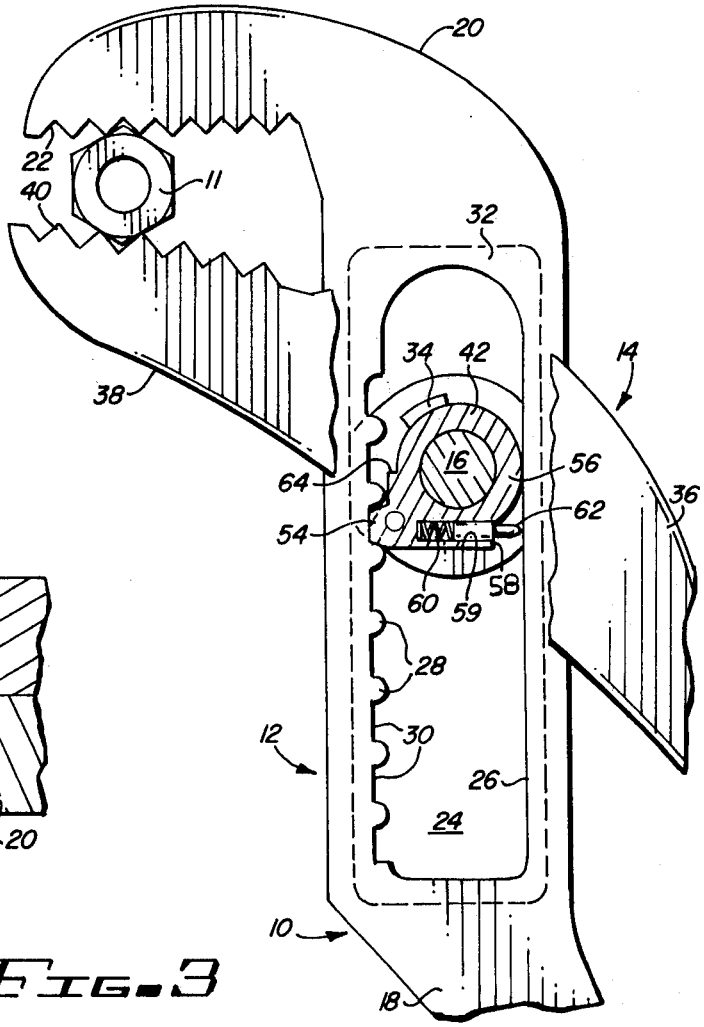
FIG. 3 is a fragmentary elevational view of a portion of the tool of FIG. 1, illustrating the construction of the slot and ratchet dog in its engaged mode.
Figure 4:
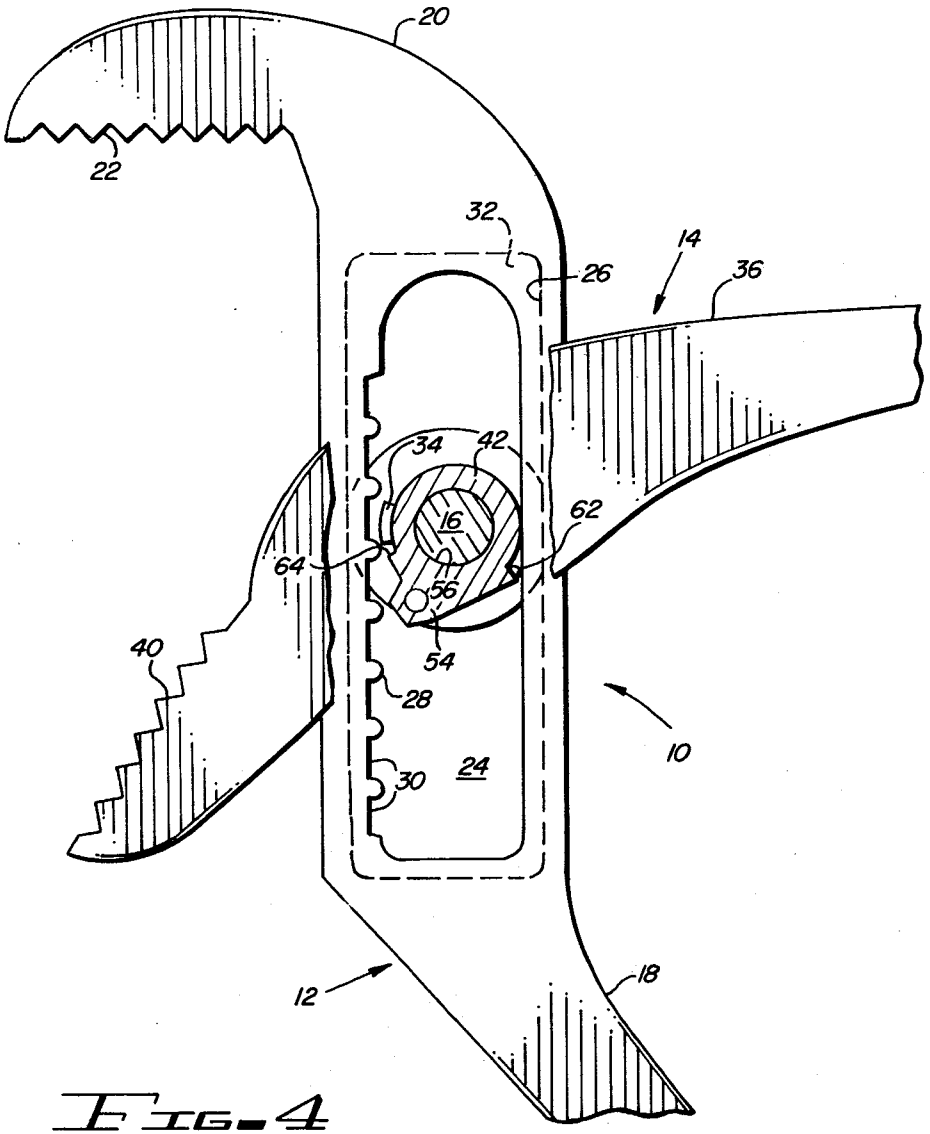
FIG. 4 is a fragmentary elevational view of a portion of the tool of FIG. 1, illustrating the construction of the slot and ratchet dog in its disengaged mode.

The operation of pliers 10 is illustrated in FIGS. 3–4. Specifically, FIG. 3 shows a workpiece 11 fully engaged by jaw members 20 and 38. At this time, tooth 54 of ratchet dog 42 is fully engaged in cavity 30. The engagement of ratchet dog tooth 54 and cavity 30 is directly proportional to the closing pressure applied to handles 18 and 36. Where it is desired to readjust one jaw member relative to the other to accommodate a different size workpiece, ratchet dog 42 is released from its engagement with tooth cavity 30. This is accomplished, as shown in FIG. 4, by pivoting handles 36 away from handle 18 until abutment 34 (shown in section) engages release shelf 64 of ratchet dog 42. As the handles are further pivoted away from one another, abutment 34, in contact with shelf 64, urges ratchet dog 42 to pivot counterclockwise. The biasing effect of ratchet pin 62 is overcome and tooth 54 is disengaged from tooth cavity 30 whereupon jaw member 20 may be readjusted relative to jaw member 38. When the handle members 18 and 36 are pivoted toward one another, abutment 34 is radially displaced from its contact with ratchet dog shelf 64.

This clockwise movement of abutment 34 allows ratchet pin 62 to again impart a biasing force on ratchet dog 42 which is urged to pivot clockwise until tooth 54 reengages tooth cavity 30.

The jaw members are speedily closed by merely shifting jaw member 38 in a direction parallel to slot 24 and toward jaw member 20. Ratchet dog 42 will pivot out of engagement with tooth cavity 30 whereupon the jaws may be closed to a selected position. When the selected position is reached, ratchet dog 42 is biased into reengagement with tooth cavity 30.

Figure 5:
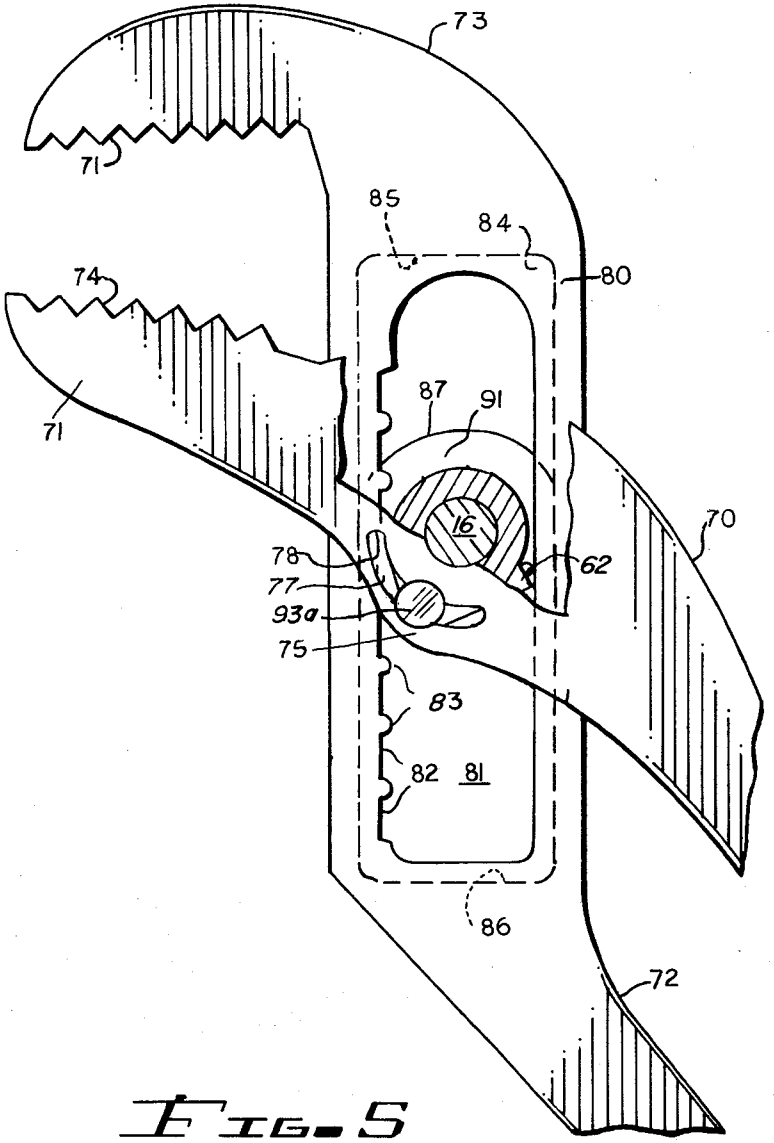
FIG. 5 is a fragmentary elevation of the invention (second embodiment) showing the pliers in a rapid closing mode.
Figure 7:
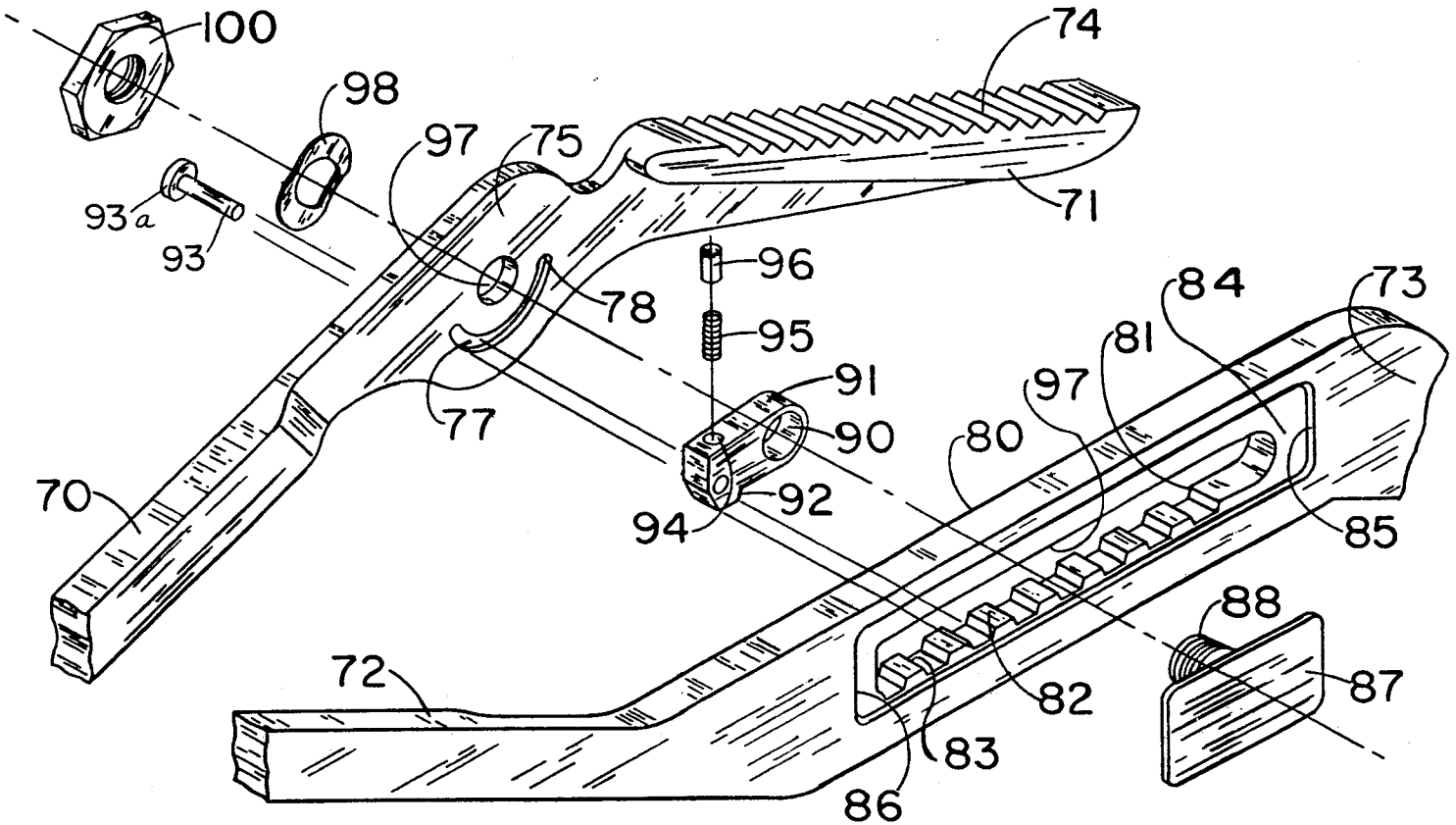
FIG. 7 is an exploded view of the second embodiment of the pliers in accordance with this invention.

Referring now to FIGS. 5 and 7, a second embodiment of the present invention is illustrated having a first handle 70, having a jaw 71 on one end portion thereof, and a second handle 72 having a jaw portion 73. Jaw 71 has a serrated jaw surface 74 and has a connecting portion 75 for connecting the handles together. An aperture 97 extends through the connecting portion 75 which has an arcuate channel or slot 77 extending entirely through portion 75, the terminal end thereof providing stop 78. Handle 72 has an elongated connecting portion 80 for connecting with the connecting portion 75 attached to handle 70. The connecting portion 80 has an elongated slot 81 having a gear rack 82 on one side thereof having a plurality of notched gear teeth 83. On one side of the connecting portion 80 is a recessed sliding track 84 having a stop 85 on one end and a stop 86 on the other end thereof. The handles 70 and 72 are connected by a slide 87 having a threaded shaft 88 on one side thereof. The slide 87 slides in the slide track 84 but is stopped at either end of the slide track 84 by the stops 85 or 86. The threaded shaft 88 is connected through a shaft opening 90 in a locking pawl 91 which rides in the elongated opening 81 of the assembled pliers. Pawl 91 has a ratchet pawl 92 and a protruding release pin 93 protruding out one side thereof and extending through the slot 77. The pawl also has a bore 94 having a spring 95 therein and a pin 96 sliding in the opening 94 on top of the spring 95, thereby providing a spring biased pin biased against a surface 97 opposite the notched gear rack 82 of the elongated opening 81. The pin 93 rides in the channel 77 in the assembled pliers and will ride until it reaches the stop 78 so that by opening the pliers until the release pin 93 engages the stop 78 the pawl 91 is released from the gear rack 82 to allow the pliers to be slid in the opposite direction for opening the jaws of the pliers. Pin 93 has an enlarged end 93*a* which provides a means for the operator to manually pivot the pawl 91 out of engagement with the rack 82.

In this modification, the handle 70 need not be pivoted to a position where the stop 78 will pivot the pawl to release position although it can be if so desired. Instead, actuation of pin 93 can perform the release operation.

When closing the jaws onto a nut, the handles can be slid closing the jaws without the jaws being opened since the pawl tooth 92 is spring loaded and will slide in the gears 83 on the rack 82. The threaded shaft 88 passes through an aperture 97 in the connecting portion 75 of the handle 70 and through a wave washer 98 and has a nut 100 threaded thereonto.

As can be seen from this and the other drawings, the adjustable pliers of the present invention, advantageously, allow the jaws to be slid onto a nut without opening the pliers for making special adjustments, which jaws are locked in the proper position onto the nut. For retracting the jaws, the handles need only be opened to a position where the pin 93 engages the stop 78 releasing the pawl 91 and pawl tooth 92 to slide the jaws apart, or pin 93 can be slid in slot 77 as previously disclosed. This simplified version of an adjustable pliers mechanism not only is easy and fast to use, but is easily manufactured with a minimum of components and a versatile adjustable pliers mechanism.

While the foregoing description has shown and described the fundamental novel features as applied to the preferred embodiments, it will be understood by those skilled in the art that modifications embodied in various forms may be made without departing from the spirit and scope of the invention.

The embodiments of the invention in which an exclusive property or privilege is claimed are defined as follows:

1. An adjustable ratchet pliers comprising in combination:

a first jaw member including a handle and a jaw portion said first jaw member having an elongated slot formed therein with a plurality of notches formed in at least one elongated side of said elongated slot;

a second jaw member including a handle and a jaw portion, said second jaw member being pivotally coupled to said first jaw member;

slide track means formed along the sides of said elongated slot in said first jaw member, said slide track means including a sunken area located outwardly and along at least two elongated sides of said elongated slot in said first jaw member;

slide means for sliding said second jaw member relative to said first jaw member, said slide means having a shaft and a sliding member, said shaft being connected to said second jaw member and extended through said elongated slot in said first jaw means, said slide member being attached to said shaft and slidably positioned on said slide track, and said sliding member being a flat member having a width greater than said elongated slot, substantially equal to the width of said sunken area and sliding in said slide track means sunken area adjacent said elongated slot in said first jaw member thereby laterally positioning said shaft in said slot regardless of the longitudinal position therein;

locking means pivotally mounted on said slide means shaft relative to said sliding member and extending into said elongated slot for engaging said notches therein, said sliding member thereby also laterally positioning the pivotal axis of said locking means, biasing means including means engaging said locking means and pivotally biasing said locking means about said pivotal axis relative to said sliding member into engaging position within at least one of said notches;

releasing means for rapidly releasing said locking means from a notched position, said releasing means including a means on said locking means engagable for rotating said locking means relative to said slide member against the bias of said biasing means out of engagement with said notches for permitting said slide member to slide on the sunken area of said track means thereby permitting said second jaw to be slid relative to said first jaw for moving said jaws to open position, said locking means and notches being shaped to permit said jaws to be slid into closed position when said locking means is in a notched position engaging said notches.

2. The adjustable ratchet pliers of claim 1 in which said means on said locking means includes a portion of said locking means, said portion of said locking means being engageable by a stop on said second jaw when said first and second jaw members are rotated in one position relative to each other whereby when said stop on said second jaw engages with said portion of said locking means said locking means is released permitting sliding adjustment of said pliers jaws to open position relative to each other; said locking means being biased into locked position when said jaw members are rotated to their original position.

3. The adjustable ratchet pliers of claim 1 in which the means on said locking means includes a pin extending through an elongated slot in the second jaw member, said pin being engageable and operable by the operator of the pliers for sliding the pin in said slot independent of the handles to pivot said locking means out of engagement with said notches permitting said jaws to be slid relative to each other for moving said jaws to open position.

4. The adjustable ratchet pliers of claim 2 in which the said portion of said locking means includes a pin extending through an elongated slot in the second jaw member, and the stop on said second jaw is one of the terminal ends of said slot whereby when the secnd handle is rotated relative to said first handle the engagement of said pin by the terminal end of said slot rotates said locking means; said pin also being engagable and operable by the operator of the pliers for sliding the pin in said slot independent of the handles to pivot said locking means out of engagement with said notches permitting said jaws to be slid relative to each other for moving said jaws to open position.

* * * * *